United States Patent [19]

Kassai

[11] Patent Number: 4,556,249

[45] Date of Patent: Dec. 3, 1985

[54] COLLAPSIBLE CHAIR

[75] Inventor: Kenzou Kassai, Osaka, Japan

[73] Assignee: Kassai Kabushikikaisha, Osaka, Japan

[21] Appl. No.: 561,538

[22] Filed: Dec. 14, 1983

[30] Foreign Application Priority Data

Dec. 27, 1982 [JP] Japan ..... 57-199330[U]

[51] Int. Cl.[4] ..... A47C 4/00

[52] U.S. Cl. ..... 297/30; 297/35; 297/46; 297/48

[58] Field of Search ..... 297/30, 46, 48, 47, 297/32, 35, 52, 59

[56] References Cited

U.S. PATENT DOCUMENTS

| | | | |
|---|---|---|---|
| 700,266 | 5/1902 | Wagner | 297/48 |
| 1,004,489 | 9/1911 | Sperl | 297/46 |
| 1,460,291 | 6/1923 | Truffy | 297/46 |
| 2,021,808 | 11/1935 | Platter | 297/46 |
| 2,679,894 | 6/1954 | Lindsay | 297/30 |
| 3,101,970 | 8/1963 | Karmel | 297/39 X |
| 3,189,380 | 6/1965 | Requitti | 297/46 X |
| 3,224,530 | 12/1965 | King et al. | 297/30 |
| 3,671,072 | 6/1972 | Holt | 297/48 |
| 3,815,952 | 6/1974 | Minsker | 297/47 |

*Primary Examiner*—Francis K. Zugel

*Attorney, Agent, or Firm*—W. G. Fasse; D. H. Kane, Jr.

[57] ABSTRACT

A collapsible high chair includes a pair of front legs (14) pivotally connected by pivot pins (13) to a pair of backrest holding rods (6) which hold a backrest (3), whereby an upper end portion of each front leg (14) overlaps a lower end portion of the associated backrest holding rod (6). Two rear legs (16) are pivotally connected respectively to the lower ends of the backrest holding rods (6) by pivot pins (15). The backrest holding rods (6) are pivotally connected at their intermediate portions to the rear portion of a seat (2) by pivot pins (5). Two seat support rods (20) are operatively connected between the front portion of the seat (2) and the front legs (14). When the lower ends of the backrest holding rods (6) are moved away from the front legs (14), the backrest holding rods (6), seat (2), front legs (14) and rear legs (16) assume a substantially horizontal state. In this manner, the chair can be folded for reducing its dimension in the direction of its height.

6 Claims, 6 Drawing Figures

COLLAPSIBLE CHAIR

BACKGROUND OF THE INVENTION

1. Field of the Invention

This invention relates to a collapsible chair and more particularly it relates to improvements in a collapsible chair which is advantageously applied to a chair for children generally referred to as a "high chair".

2. Description of the Prior Art

A "high chair" has its seat portion formed at a relatively high level, so that by seating a child thereon the child is raised to a level sufficient for the height of a table for adults. Thus, the use of this "high chair" enables the child to eat or do other things at the same table as adults do.

A "high chair" literally has a relatively large dimension in height and, generally, is usually constructed so that the dimension in height is greater than the dimension in the horizontal direction.

A collapsible chair is advantageous in that it can be stored in compact form when it becomes unnecessary. A typical collapsible construction for collapsible chairs is seen, e.g., in a "pipe chair" and in a state after collapse the longitudinal dimension is reduced, providing a relatively thin compact collapsed configuration. There is a known construction wherein the collapsible construction utilized in such a "pipe chair" is applied to a "high chair" to make the latter collapsible. However, since a "high chair" is greater in the height dimension than in the horizontal dimension, as described above, the bulk cannot be reduced so much even if there is obtained a collapsed state in which the longitudinal dimension is reduced as in a "pipe chair." That is, in such a "high chair," it is desired that the collapsing action proceeds in a direction which reduces the height dimension, whereby a compact collapsed state can be obtained.

SUMMARY OF THE INVENTION

Accordingly, a principal object of this invention is to provide a collapsible chair constructed so that its height dimension can be sufficiently reduced to provide a compact collapsed state.

Another object of this invention is to provide a collapsible chair which can be easily collapsed.

In brief, this invention is a collapsible chair including the following components.

(a) A seat section having a seat and a backrest;

(b) a pair of backrest holding rods pivotally supported at first pivot points positioned on relatively rear regions of opposite sides of said seat, said backrest holding rods extending upwardly and downwardly from said first pivot points over respective predetermined lengths, the upper portions of said rods holding said backrest;

(c) a pair of front legs pivotally supported at second pivot points positioned at relatively upper regions of the lower portions of said backrest holding rods, said front legs being adapted to turn only forwardly from a position in which they are arranged side by side with the backrest holding rods;

(d) a pair of rear legs pivotally supported at third pivot points positioned on relatively lower regions of the lower portions of the backrest holding rods, said rear legs being adapted to turn only forwardly from a position in which they extend obliquely downwardly of said backrest holding rods;

(e) pair of seat support rods pivotally connected between fourth pivot points positioned below said second pivot points for said front legs and fifth pivot points positioned on relatively forward regions of opposite sides of said seat; and (f) Locking means for maintaining the side-by-side relation between said front legs and said backrest holding rods and for selectively inhibiting the forward turning of said front legs relative to said backrest holding rods.

According to the arrangement described above, when the locking means are maintaining the front legs and backrest holding rods in the side-by-side relation, the open state of this collapsible chair is established. In this open state, the seat is kept substantially horizontal, and the pair of seat support rods serve to maintain such attitude of the seat. The front legs, in side-by-side relation to the backrest holding rods, extend forwardly and downwardly substantially from the middle portion of the collapsible chair. The rear legs extend rearwardly and downwardly substantially from the middle portion of the collapsible chair.

In such open state, if the locking means are released, the side-by-side relation between the front legs and backrest holding rods can be canceled. Therefore, the front legs are turned forwardly around the second pivot points, and when they have turned through about 180 degrees, they assume a position substantially parallel to the backrest holding rods. In response thereto, the seat is also turned by the seat support rods until it is substantially parallel to the backrest holding rods. The rear legs are turned forwardly around the third pivot points, and when they have turned through about 180 degrees, the front legs and backrest holding rods are substantially parallel to each other. In this manner, when said respective elements are in a position substantially parallel to each other, the closed state of this collapsible chair is obtained.

The factor which determines the height dimension of the collapsible chair in the open state is substantially the distance from the upper ends of the backrest holding rods to the lower ends of the front or rear legs. The backrest holding rods are pivotally connected to the front legs by the second pivot points and to the rear legs by the third pivot points. When they are turned, the backrest holding rods and the front and rear legs are caused to overlap each other, so that in the closed state, the sum of the widthwise dimensions of the longitudinal elements determines the height dimension. Therefore, the height dimension can be fully reduced in the closed state. As for the horizontal dimension in the closed state, the distance from the upper end of the backrest holding rod to the lower end of the front or rear leg, which distance is the longest dimension in the open state, is reduced approximately to one half of its open length because these components are folded in two. Thus, the horizontal dimension in the closed state can also be fully reduced. If, therefore, this invention is applied to a chair having a relatively large height dimension, such as a "high chair," the chair can be brought into more compact form when closed. Further, since the turnable connections between the components included in such collapsible chair have axes which are substantially parallel to each other, the operation for a change from the open to the closed state or from the closed to the open state can be achieved by an action in one direction. Therefore, the operations for a change from the open to the closed state and from the closed to the open state can each be performed in a series of similar steps without requiring two or more separate procedures.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
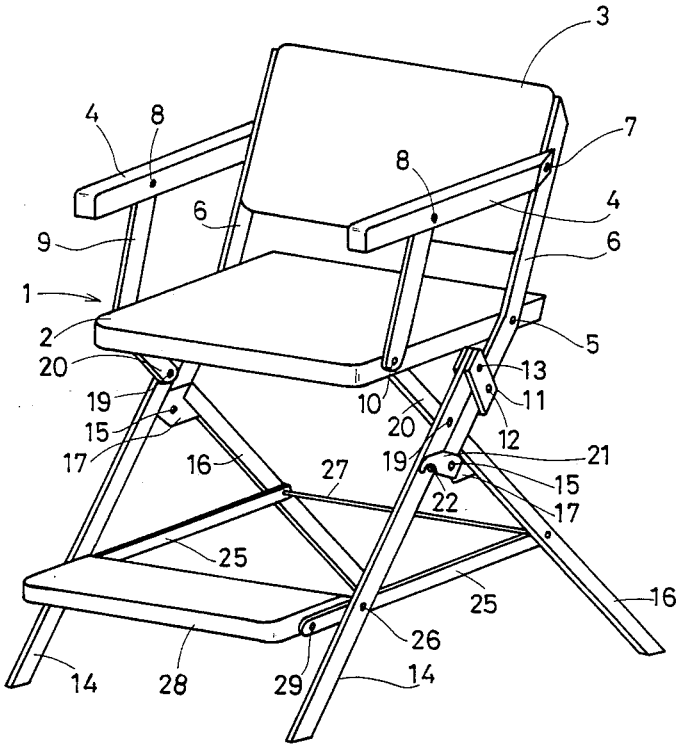
FIG. 1 is a perspective view showing the external appearance of an embodiment of this invention.
Figure 3:
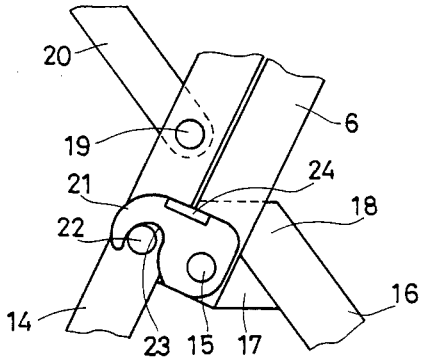
FIG. 3 is an enlarged view of a portion of locking means for securing the open state.
Figure 2:
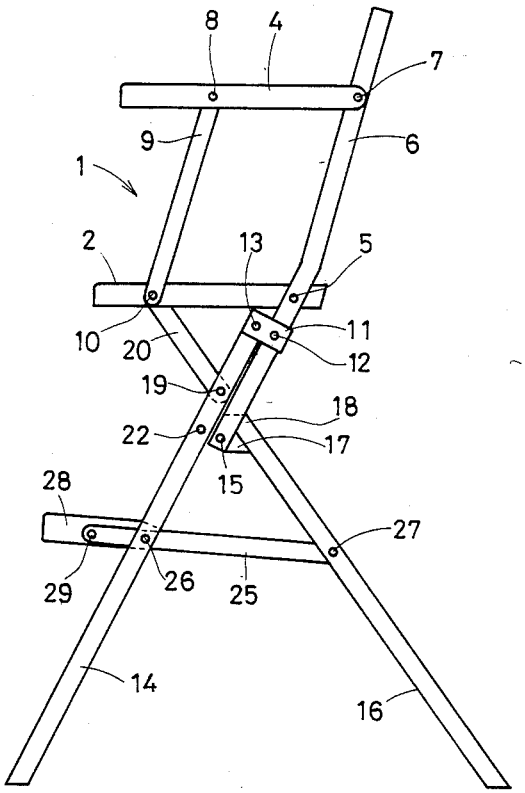
FIG. 2 is a left-hand side view of the collapsible chair of FIG. 1.

Referring first to FIGS. 1, 2 and 3, the seat section 1 of this collapsible chair is provided with a seat 2, a backrest 3 and a pair of armrests 4. A pair of backrest holding rods 6 are pivotally supported by pivot pins 5 positioned on relatively rear regions of opposite sides of the seat 2. Each backrest holding rod 6 extends upwardly and downwardly from the position of the pivot pin 5 over a predetermined length. The backrest 3 is held by the upper portions of the backrest holding rods 6. Further, the armrests 4 are pivotally supported by pivot pins 7 positioned on the upper portions of the backrest holding rods 6. Each armrest 4 extends forwardly of the pivot pin 7, and the forward portion of the armrest 4 is turnably connected to the upper end of an armrest support rod 9. The lower ends of armrest support rods 9 are turnably connected to the seat 2 by pivot pins 10 positioned on relatively forward regions of opposite sides of the seat 2. In addition, each armrest 4 is in the form of a downwardly open channel in which the upper end of the armrest support rod 9 is received. As best shown in FIG. 2, the seat 2, backrest holding rod 6, armrest 4 and armrest support rod 9 constitute substantially a parallelogram linkage.

A bracket 11 is attached to a relatively upper region of the lower portion of each backrest holding rod 6 by a fixed pin 12. Each bracket 11 is provided with a pivot pin 13, whereby a front leg 14 is pivotally supported. Each of the front legs 14 is positioned forwardly of the backrest holding rod 6 and on the plane of a side of the backrest holding rod 6. Thus, a state is obtained in which each front leg 14 contacts the associated backrest holding rod 6, which state defines one end of the range of turning of the front leg 14. That is, each front leg 14 is adapted to turn only forwardly from the state in which it is arranged side by side with the associated backrest holding rod 6.

A pair of rear legs 16 are turnably supported by pivot pins 15 positioned on relatively lower regions of the lower portions of the backrest holding rods 6. A closer look at this pivotal portion shown in FIG. 3 will show that each rear leg 16 has a connecting plate 17 extending from the lateral surface of the upper end thereof. Actually, a pivot pin 15 extends through each connecting plate 17. With such a connecting arrangement, each rear leg 16 is positioned rearwardly of the backrest holding rod 6 and a side of each rear leg 16 is aligned with a side of the backrest holding rod 6. Thus, there is obtained a state in which the upper end 18 of each rear leg 16 contacts the rear surface of the associated backrest holding rod 6, which state defines one end of the range of turning of the rear leg 16. That is, each rear leg 16 is adapted to turn only forwardly from the state in which it extends obliquely downward from the backrest holding rod 6.

A pair of seat support rods 20 are turnably connected to the front legs 14 by pivot pins 19 positioned below the pivot pins 13. The upper ends of the seat support rods 20 are turnably connected to relatively forward regions of opposite sides of the seat 2. For this purpose, for example, the pivot pins 10 serve as pins for pivotally supporting the seat support rods 20. The lower surface of the seat 2 is formed with an opening for receiving the upper ends of the seat support rods 20, and when they are received, the pivot pins 10 are passed through the upper ends of the seat support rods 20.

Locking means are provided for maintaining the side-by-side relation between each front leg 14 and the associated backrest holding rod 6. As shown in FIGS. 1 and 3, the locking means comprise, in combination, an engaging member 21 and an engaging pin 22. The engaging member 21 is turnably attached to the lower end of the backrest holding rod 6 by the pivot pin 15. The engaging pin 22 is provided on the front leg 14. The engaging member 21 is not shown in FIG. 2. The engaging member 21 is formed with a recess 23 for receiving the engaging pin 22. Further, as shown in FIG. 3, the engaging member 21 may be provided with an operating tab 24 extending toward the viewer in order to facilitate manipulation of the engaging member 21. The positions at which the engaging member 21 and engaging pin 22 are respectively provided may be interchanged.

A pair of leg connecting rods 25 are provided for connecting intermediate portions of the front legs 14 to intermediate portions of the rear legs 16. The front end of each leg connecting rod 25 is turnably connected to the front leg 14 by a pivot pin 26. The rear ends of the leg connecting rods 25 are turnably connected to the rear legs 16 by a transverse rod 27 serving as a pivot shaft. The transverse rod 27 connects the pair of rear legs 16. The transverse rod 27 keeps constant the distance between the rear legs 16 and reinforces the rear legs 16 and it also assists the turning of both rear legs 16 at the same time during the collapsing of the chair. A footrest 28 is connected between the front ends of the leg connecting rods 25. The footrest 28 is fixedly attached to the leg connecting rods 25 by the aforesaid pivot pins 26 and by fixed pins 29 positioned forwardly of said pivot pins 26 and provided on the leg connecting rods 26. The footrest 28 keeps constant the distance between the front legs 14 and assists the turning of both front legs 14 at the same time during the collapsing of the chair.

The opening and closing operations of the collapsible chair will now be described.

In the opened state shown in FIGS. 1 and 2, the backrest holding rods 6 and front legs 14 are maintained in the side-by-side relation in that the engaging members 21 are engaged with the engaging pins 22, so that the front legs 14 are inhibited from forwardly turning relative to the backrest holding rods 6. The rear legs 16 are inhibited from rearwardly turning around the pivot pins 15 in that their front ends 18 are contacted with the rear surfaces of the backrest holding rods 6, whereby the opening angle between the front and rear legs 14 and 16 is fixed. In addition, in the preferred embodiment, the rods 25 which connect the front and rear legs in pairs fix the opening angle between the front and rear legs 14 and 16. As best seen in FIGS. 1 and 2, seat 2 is fixed in a substantially horizontal position by the seat support rods 20. Further, the armrests 4 are also fixed in a substantially horizontal position by the armrest support rods 9.

When it is desired to change the open state to the closed state, the operating members 21 are disengaged from the engaging pins 22. As a result, it becomes possible to cancel the side-by-side relation between the backrest holding rods 6 and the front legs 14. The closing operation proceeds through the state shown in FIGS. 4 and 5 until the closed state shown in FIG. 6 is obtained.

Figure 4:
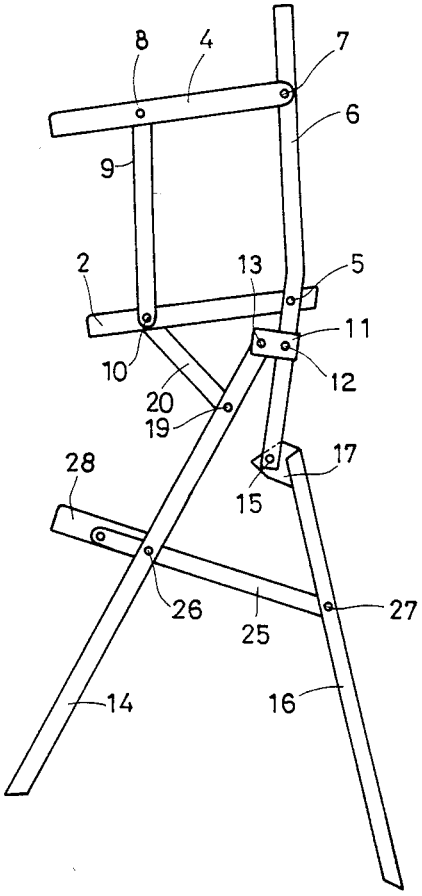
FIGS. 4 and 5 are left-hand side views showing intermediate states of the chair of FIGS. 1 and 2 as the chair is being collapsed.

Referring to FIG. 4, when an upward force is applied to the backrest holding rods 6 while raising the lower ends of the front legs 14, a turning action is produced around the pivot pins 13, thus canceling the side-by-side relation between the backrest holding rods 6 and the front legs 14 while causing the backrest holding rods 6 to lie substantially side by side or aligned with the rear legs 16. With the turning of the front legs 14, the seat 2 is slightly turned clockwise around the pivot pins 5 through the seat support rods 20, while the armrests 4 are turned clockwise around the pivot pins 7 through the armrest support rods 9.

Figure 5:
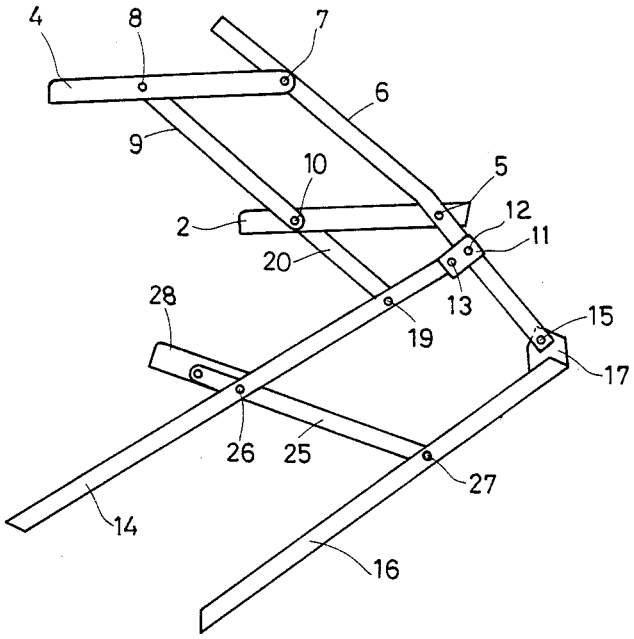

Referring to FIG. 5, the direction of bending of the backrest holding rods 6 and rear legs 16 is opposite to that shown in FIG. 2. That is, when the operation has gone through the state of FIG. 4, it is only necessary to apply downward forces to the backrest holding rods 6. However, since these forces will be naturally applied by gravity, there is no need for the user to take the trouble to apply them. In the state shown in FIG. 5, the turning of the front legs 14, seat 2 and armrests 4 further proceeds.

Figure 6:
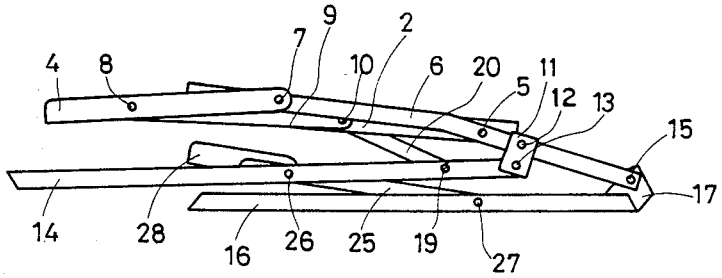
FIG. 6 is a left-hand side view of the collapsible chair of FIGS. 1 and 2 after it has been collapsed.

As the turning proceeds, eventually, the closed state shown in FIG. 6 is attained. In this closed state, the backrest holding rods 6, armrests 4, armrest support rods 9, seat 2, front legs 14, and rear legs 16 are substantially parallel to each other. That is, the dimension in the direction of the height is greatly reduced. Further, since the distance from the front legs 14 or rear legs 16 to the backrest holding rods 6, which distance defines the height dimension of this collapsible chair in the opened state, is reduced to about half, the horizontal dimension is also reduced.

In FIGS. 4 to 6, the engaging member 21 and engaging pin 22, which constitute the locking means, are omitted from illustration.

When it is desired to bring the chair from the closed state of FIG. 6 to the open state of FIG. 2, the just described operations are performed in the reverse order. That is, raising the upper ends of the backrest holding rods 6, for example, brings about the state of FIG. 5 then the state shown in FIG. 4 is reached, in which state a force applied for moving the lower ends of the backrest holding rods 6 toward the front legs 14 brings about the state shown in FIG. 2. Thereupon, the engaging members 21 are moved to engage the pins 22, whereby this open state is locked.

A preferred embodiment of this invention has so far been described, but other embodiments are possible without departing from the scope of this invention.

For example, one end of the range of turning of the front legs 14 relative to the backrest holding rods 6 has been defined by the arrangement wherein the front legs 14 directly abut against the backrest holding rods 6, but this arrangement may be replaced by another one wherein one member is provided with a projection or the like which abuts against the other member. The same may be said of the relationship between the rear legs 16 and the backrest holding rods 6.

In this invention, the armrests 4 are not absolutely necessary. Therefore, an embodiment is possible wherein the armrests 4 and the armrest support rods 9 are absent.

The footrest 28 also not absolutely necessary; thus, the pair of pivot pins 26 may be replaced by a single shaft, such as the transverse rod 27. Further, an embodiment is possible which has no such footrest 28 or shaft. Similarly, an embodiment is possible which does not include the transverse rod 27 connected between the pair of rear legs 16.

The pair of leg connecting rods 25 are convenient for interlocking the front and rear legs 14 and 16 during the collapsing operation. However, even if such leg connecting rods are not provided, the expected function of the collapsible chair can fully be developed. That is, when this collapsible chair in the opened state is raised, the rear legs would hang down, but this situation does not matter at all at least when the chair is used.

As for the locking means, various modifications may be contemplated besides the above combination of an engaging member 21 and an engaging pin 22. For example, when the function of the locking means is considered, it is seen that it is only necessary to maintain the side-by-side relation between the front legs and the backrest holding rods. Therefore, it is possible to substitute an annular member adapted to fit on the area where the backrest holding rod and the front leg overlap each other, said annular member being arranged to slide along the front leg or the backrest holding rod.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A collapsible chair comprising: a seat section (1) having a seat (2) and a backrest (3), a pair of backrest holding rods (6) pivotally supported at first pivot points (5) positioned on relatively back regions of opposite sides of said seat (2), said rods (6) extending upwardly and downwardly from said first pivot points (5) over respective predetermined lengths, the upper portions of said rods (6) holding said backrest (3), a pair of front legs (14) pivotally supported at second pivot points (13) positioned at relatively lower regions of the lower portions of said backrest holding rods (6), said front legs (14) being adapted to turn only forwardly from a position in which they are arranged side by side with said backrest holding rods (6), a pair of rear legs (16) pivotally supported at third pivot points (15) positioned on relatively lower regions of the lower portions of said backrest holding rods (6), said rear legs being adapted to turn only forwardly from a position in which they extend obliquely downwardly from said backrest holding rods (6), a pair of seat supporting rods (20) pivotally connected between fourth pivot points (19) positioned below said second pivot points (13) for said front legs

(14) and fifth pivot points (10) positioned on relatively forward regions of opposite sides of said seat (2), locking means (21, 22) for maintaining the side-by-side relation between said front legs (14) and said backrest holding rods (6) and for selectively inhibiting the forward turning of said front legs (14) relative to said backrest holding rods (6), a pair of brackets (11) forwardly projecting from said backrest holding rod (6), one of said second pivot points (13) being positioned on each bracket (11), wherein each front leg (14) is positioned forwardly of said backrest holding rod (6) and on a plane defined by a side of the backrest holding rod (6), wherein one end of a turning range of the front legs (14) is defined when each front leg (14) and the respective backrest holding rod (6) abut against each other along narrow sides, whereby a predetermined length of lower portions of said backrest holding rods extend substantially in parallel with a respective length of upper portions of said front legs along said narrow sides for keeping said chair in an open state, a pair of connecting plates (17) for pivotally supporting upper ends (18) of said rear legs at said third pivot points (15), each connecting plate (17) extending along a lateral surface of the upper end of the respective rear leg and rearwardly of the respective backrest holding rod (6) in a plane also along a side of the respective backrest holding rod (6), whereby said upper ends of said rear legs (16) directly contact a rear surface of the respective backrest holding rod (6), and wherein one end of a turning range of the rear legs (16) is defined when the upper end of each rear leg (16) abuts against the rear surface of the backrest holding rod (6) for keeping said chair in an open state.

2. The collapsible chair of claim 1, wherein said seat section (1) further includes a pair of armrests (4) pivotally supported in the upper portions of said backrest holding rods (6) and extending forwardly, and a pair of armrest support rods (9) connected between the front portions of said armrests (4) and the front portions of opposite sides of said seat (2).

3. The collapsible chair of claim 1, wherein said locking means comprise an engaging member (21) and wherein an engaging pin (22) engageable by said engaging member (21), and said engaging member (21) is turnably attached to the lower portion of said backrest holding rod (6), while said engaging pin (22) is provided on said front leg (14).

4. The collapsible chair of claim 1, further including a pair of leg connecting rods (25) each turnably connected to an intermediate portion of said front legs (14) and to the intermediate portion of said rear legs (16).

5. The collapsible chair of claim 4, further including a footrest (28) connecting the front ends of said pair of leg connecting rods (25).

6. The collapsible chair of claim 4, further including a transverse rod (27) connecting the rear ends of said pair of leg connecting rods (25).

* * * * *

UNITED STATES PATENT AND TRADEMARK OFFICE

CERTIFICATE OF CORRECTION

PATENT NO. : 4,556,249

DATED : December 3, 1985

INVENTOR(S) : Kenzou Kassai

It is certified that error appears in the above—identified patent and that said Letters Patent is hereby corrected as shown below:

Claim 3, line 3, delete "wherein";
line 4, after "and" insert --wherein--.

Signed and Sealed this

*Eleventh* Day of *March 1986*

[SEAL]

*Attest:*

DONALD J. QUIGG

*Attesting Officer*

*Commissioner of Patents and Trademarks*